United States Patent [19]

Feinberg et al.

[11] 4,161,247

[45] * Jul. 17, 1979

[54] METHOD OF AND MEANS FOR PRESERVING TENNIS BALLS OR THE LIKE

[76] Inventors: Robert S. Feinberg, 81 Edgemont Pl., Teaneck, N.J. 07666; David A. Selick, 76 Le Roy St., Tenafly, N.J. 07670

[ * ] Notice: The portion of the term of this patent subsequent to Jun. 17, 1992, has been disclaimed.

[21] Appl. No.: 859,999

[22] Filed: Dec. 13, 1977

Related U.S. Application Data

[60] Continuation of Ser. No. 564,347, Apr. 2, 1975, abandoned, which is a division of Ser. No. 347,080, Apr. 4, 1973, Pat. No. 3,889,807.

[51] Int. Cl.[2] ..... B65D 45/32; B65D 85/00

[52] U.S. Cl. ..... 206/315 B; 206/522; 220/320; 273/61 D

[58] Field of Search ..... 206/315 B, 522; 220/320, 212, 4 E; 215/274, 228; 273/61 D

[56] References Cited

U.S. PATENT DOCUMENTS

| | | | |
|---|---|---|---|
| 1,910,930 | 5/1933 | Morris | 206/315 B |
| 2,714,469 | 8/1955 | Carlson | 220/320 |
| 3,233,727 | 2/1966 | Wilson | 206/315 B |
| 3,270,871 | 9/1966 | Pushkin | 215/274 |

*Primary Examiner*—William T. Dixson, Jr.
*Attorney, Agent, or Firm*—Howard C. Miskin

[57] ABSTRACT

A gas pressurized ball is packaged under pressure by first compressing the ball about its girth and then compressing it about its full surface in the smaller spherical cavity of a mold section. A device for compressing the ball includes a collar member of smaller diameter than the ball and a pair of spherically faced cavitied mold members which are assembled with the collar to form a spherical closure chamber. The mold members may include lips which enter the collar opening or may, with the collar face, form the closure chamber. The collar and a spherically faced cavitied mold member, in one form, are integrally formed and a ball injection plunger registers with a bore in the mold member. Another device includes three mutually hinged members each having a cavity so that when the members are swung to a closed condition the cavities form a spherical chamber smaller than the ball. Another form of the device includes a cylindrical receptacle closed by an elastomeric cap provided with an inflation valve and locking collar to permit pressurizing of the receptacle.

2 Claims, 11 Drawing Figures

METHOD OF AND MEANS FOR PRESERVING TENNIS BALLS OR THE LIKE

This is a continuation, of application, Ser. No. 564,347, filed Apr. 2, 1975, now abandoned; which is a Division of Ser. No. 347,080 filed Apr. 4, 1973 now U.S. Pat. No. 3,889,807.

BACKGROUND OF THE INVENTION

The present invention relates generally to improvements in storage receptacles and it relates particularly to an improved receptacle for storing a gas pressurized ball under external pressure to maintain the liveliness of the ball.

In the playing of tennis and many other ball games, a gas pressurized hollow ball is employed, and in a case of tennis the ball is spherical and of a standard diameter and it is covered with a fibrous nap. Important parameters of the ball are its bounce or liveliness and this is a function of the ball's internal gas pressure, its size and spherical configuration and the condition of the fibrous nap. All of these parameters should be maintained constant and uniform from ball to ball and during the useful life of the ball. Since the reaction of the ball to the impact of the racket and its ground rebound characteristics are functions of the above parameters, any significant change or variation thereof adversely affects the proper playing of the game.

Tennis balls are generally packaged and marketed in pressurized nermetically sealed containers so as to minimize or prevent any diffusion outwardly of the pressurized gas in the ball which would reduce its liveliness and so as to obviate any distortion of the ball from its standard size or shape as a consequence of the ball's high internal pressure. However, upon opening the pressurized container the diffusion of the pressured gas from the ball and the distortion of the ball commences so that the ball is thereafter of limited useful life in the proper playing of tennis. Many devices, both of a gas pressurized and a mechanical pressing nature have heretofore been proposed for extending the life of the ball by maintaining the ball's internal pressure and shape and size but these have been complex devices which have been difficult and inconvenient to employ or they have been unsatisfactory in that they tended to damage the surface of the ball thereby adversely affecting the ball's playing properties and otherwise left much to be desired.

SUMMARY OF THE INVENTION

It is a principal object of the present invention to provide an improved method and device for preserving the playing characteristics of an internally gas pressurized ball.

Another object of the present invention is to provide an improved receptacle for preserving the playing characteristics of an internally gas pressurized ball during the storage thereof.

Still another object of the present invention is to provide an improved receptacle for gas pressurized balls which preserves the liveliness, bounce, configuration and shape of the originally packaged ball.

A further object of the present invention is to provide an improved receptacle for a pressurized ball which preserves its playing and response characteristics without adversely affecting the surface of the ball.

Still a further object of the present invention is to provide a receptacle of the above nature characterized by its reliability, ruggedness, ease and convenience of use and high versatility and adaptability.

The above and other objects of the present invention will become apparent from a reading of the following description taken in conjunction with the accompanying drawings which illustrate preferred embodiments thereof.

In a sense, the present invention contemplates the provision of a ball storing method and device in which the ball is first peripherally compressed at its girth and thereafter compressed about its full surface in mold members having a spherical cavity smaller than the normal size of the ball. The device for effecting the procedure is a multisection receptacle having a ball housing cavity of lesser size than the normal ball. In one form there is provided a compression collar of a height so as to form peripheral annular spaces between the ball and collar faces above and below the collar median horizontal plane and a pair of mold members with spherically faced cavities and annular lips mating the spaces between the collar and the registering ball. The collar may be coaxial with and integrally formed with one of the mold members. In another form of receptacle, the collar is relatively thin so that the girth compressed ball has its surface extending in a compressed condition above and below the collar and the mold members have cavities less than hemispherical. In the latter form the collar may have a cylindrically faced inner face and affect less compression of the ball girth. According to another form of the improved receptacle there are provided three relatively movable similar mold members, each having one-third of a spherical cavity so that when they are in their contracted position, a spherical cavity is formed which is of lesser size than the unstressed ball. The present invention also contemplates the provision of a ball holding pressurized tubular container having an end access opening closed by a circular elastomeric cap member with a skirt wall engaging the end peripheral outer border of the container and secured thereto by an outer ring when pressurized and a conventional inflation valve such as the automobile tire Schroder type extending through the member to permit the pressurizing of the container interior to lock the cap in position.

The improved receptacles are reliable, and easy and convenient to employ and for long periods maintain the associated ball in a preserved condition so that upon its separation it is substantially in its original condition of shape, dimensions and liveliness without any distortion or marring of the surface of the ball.

DESCRIPTION OF THE PREFERRED EMBODIMENT

Figure 1:
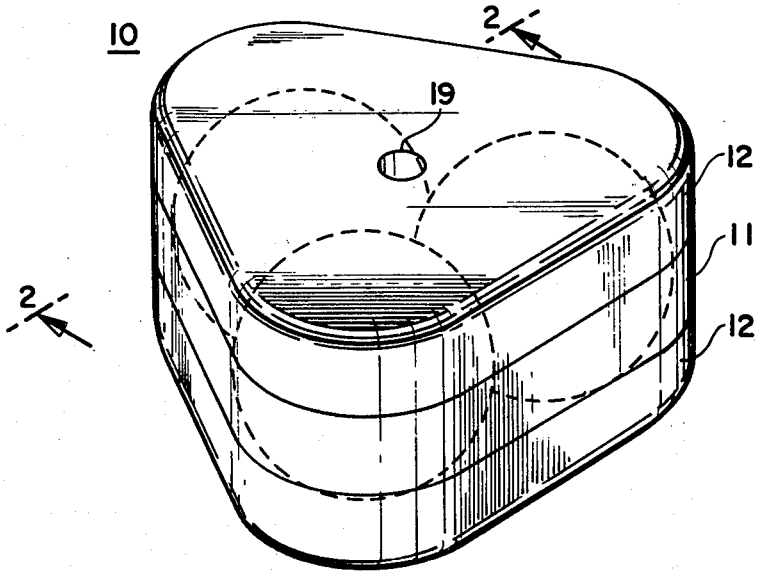
FIG. 1 is a perspective view of a preferred embodiment of the present invention as applied to a three tennis ball receptacle.
Figure 2:
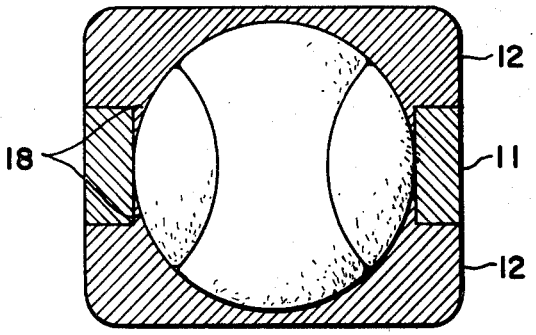
FIG. 2 is a sectional view taken along line 2—2 in FIG. 1.
Figure 3:
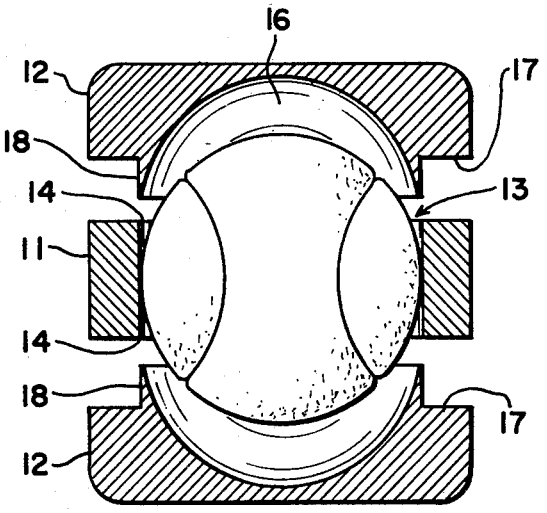
FIG. 3 is a view similar to FIG. 2 with the receptacle sections shown in a separated state.

Referring now to the drawings, and particularly FIGS. 1 to 3 thereof which illustrate a preferred embodiment of the present invention, the reference numeral 10 generally designates the improved ball press receptacle which is shown as having a three ball capacity, it being understood that it may have a lesser or greater capacity. The receptacle 10 comprises two main components or sections. A compression collar section 11 and a mold section is formed of two similarly shaped parts or members 12. Collar 11 and mold members 12 are of similar equilateral triangular perimeters with rounded corners and are formed of any suitable rigid material such as rigid thermoplastic or thermoset polymeric resins, metal or the like.

The collar section 11 has three circular openings or bores 13 formed in the corners thereof and being spaced from each other. The openings 13 are of a diameter slightly less than that of a fresh standard tennis ball B with which the receptacle 10 is employed so that when a ball B is medially positioned in an opening 13, the girth of the ball B is firmly engaged and somewhat peripherally compressed and the confronting faces of the ball B and the opening 13 delineate upper and lower annular recesses 14 of approximately triangular transverse cross section open at their outer bases.

Each of the mold members 12 has formed in its inner face three cavities 16 which are approximately herispherical, being slightly less for practical reasons, and the collar openings are disposed at the corners of mold members 12 and correspond in relative positions to those of collar openings 13 and are of a diameter equal to or slightly less than that of openings 13. Projecting inwardly from the inside face 17 of each mold member 12 and coaxial with each of the cavities 16 is an annular lip 18 which substantially mates a corresponding annular valley 14, the inside peripheral face of the lip 18 defining the outer border of a corresponding hemispherical cavity 16. Centrally formed in the members 11 and 12 are axially aligned vertical bores 19 for accommodating suitable fastening means, such as a bolt and wing nut to permit the releasable locking of the members 11 and 12 in a tightly closed assembled condition.

In employing the receptacle 10, a tennis ball B is inserted and vertically centered in each of the openings 13 to at least radially compress the nap of the tennis ball about the girth thereof as engaged by the face of the respective opening 13. Thereafter the mold members are applied to the opposite faces of the collar member 11 and pressed inwardly so that lips 18 matingly engage valleys 14 and the assembly is then axially tightened so that each ball B is fully enclosed and compressed about its full surface by a spherical cavity defined by a pair of registering cavities 16, and any small cylindrical surface between their confronting edges and defined by the faces of the collar openings.

In the closing of the receptacle 10 about the balls B, by reason of the configuration and cooperation of the collar and mold members there is no pinching or damage to the nap of the ball so that when it is removed from the receptacle the nap returns to its original uniform condition. Further, by reason of the compressed enclosure of each ball B in a closed spherical cavity, the pressure with and the dimensions and configuration of the ball are preserved so that there is no significant adverse change in the ball's properties from the time it is packaged in the receptacle 10 until it is removed.

It should be noted that while in FIGS. 1 to 3 of the drawings the lips 18 are shown abutting in the receptacle assembled condition with the cavities 16 full hemispheres and the closed cavities true spheres, these are the theoretical parameters, but for practical purposes, the cavities 16 are slightly less than hemispheres and the lips 18 in the closed receptacle are somewhat spaced apart.

Figure 4:
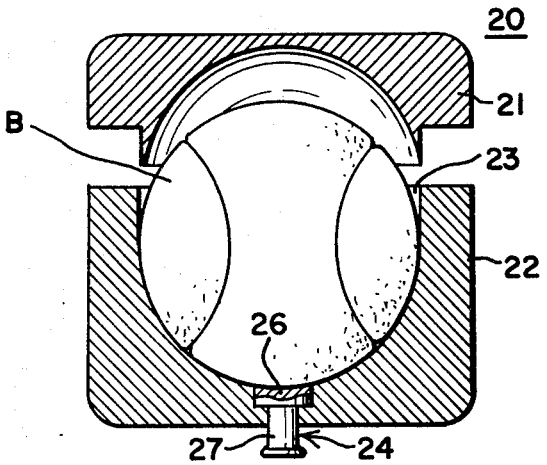
FIG. 4 is a view similar to FIG. 3 of another embodiment of the present invention.

In FIG. 4 of the drawings, there is illustrated another embodiment of the present invention which differs from the first described primarily in that the collar member and one of the mold members are integrally formed and means are provided for ejecting the balls from the respective deep cavities.

Specifically, the modified receptacle 20 includes an upper mold member 21 similar in configuration and dimensions to mold member 12 and a combined integrally formed collar and lower mold member 22 similar in size and configuration to the assembly of collar member 11 and lower mold member 12. Centrally located in the base of each of the cavities 23 in lower member 22 is a vertical axial bore which projects through the bottom of lower member 22 and is counterbored at its upper part to provide an enlarged bore section. A plunger member 24 slidably registers with each of the bores and includes an enlarged head section having a spherically surfaced top face coplanar with the spherical face of cavity 23 and a depending cylindrical bottom section 27 which projects below the underface of member 22.

In employing the receptacle 22, the balls B are pressed in cavities 23 affecting the compression thereof and leaving annular upper valleys corresponding to valleys 14 and the upper mold member 21 is then applied in the manner earlier described. In order to remove the balls B, the receptacle 20 is opened by raising and removing the upper mold member 21 and pressing the bottom sections 27 so that the plungers 24 press against the respective balls B and raise them sufficiently out of cavities 23 to permit the hand removal thereof.

Figure 5:
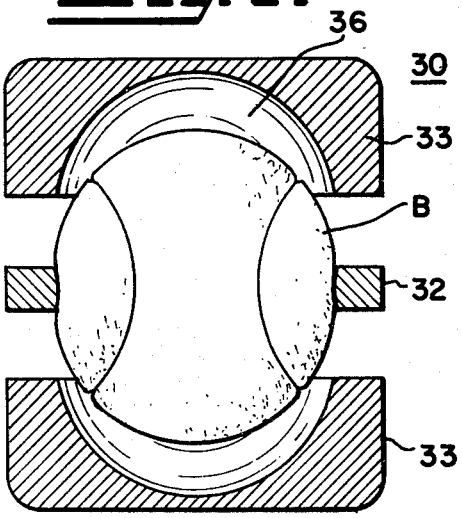
FIG. 5 is a view similar to FIG. 3 of still another object of the present invention.
Figure 6:
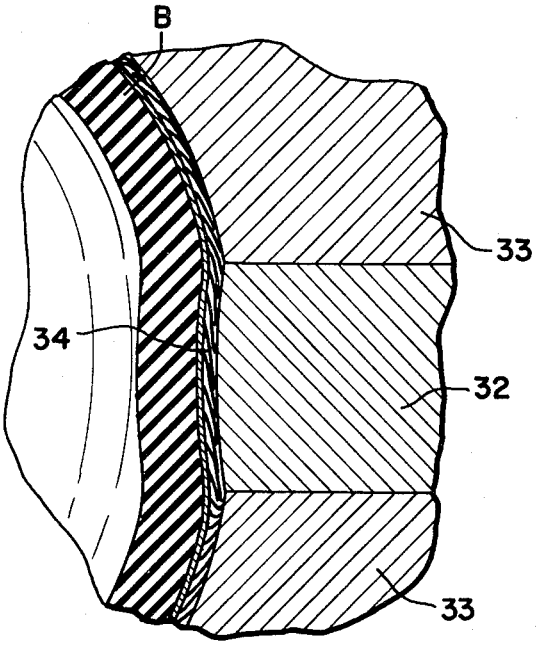
FIG. 6 is an enlarged fragmentary sectional view of the receptacle of FIG. 5 illustrated in a closed condition.

The embodiment of the present invention illustrated in FIGS. 5 and 6 of the drawings differs from that first described primarily in that the openings in the collar member define part of the spherical enclosure cavity and are smaller than the openings in collar member 11 and the collar member is of less thickness than collar member 11. The receptacle 30 of the present embodiment includes a collar member 32 and a pair of similar upper and lower mold members 33 the members 32 and 33 having perimeters corresponding to those of members 11 and 12 and being provided with correspondingly positioned cavities and openings.

The collar 32 has three circular openings of slightly less diameter than a tennis ball B, the peripheral face 34 of each opening bulging inwardly or being slightly inwardly convex so that when the ball B centrally registers with a collar opening, its girth is compressed and assumes the contour of the opening face 34, as best seen in FIG. 6 with the outer surface of ball B abutting opening face 34 being rendered concave.

The mold members 33 are of identical configuration, each including a cavity 36 with a spherical face and being somewhat less than a hemisphere so that when they are assembled with collar 32 with the collar being sandwiched between mold members 36 they form spherical cavities of somewhat smaller diameter than the unstressed diameter of the ball B and with its medial horizontal girth being inwardly bulged as defined by the face 34. Suitable means are provided for locking members 32 and 33 in an assembled closed condition.

The application, use and operation of the receptacle 30 are similar to those of receptacle 10 except that valleys 14 are not formed by the collar member for the reception of lips 17 which are absent in receptacle 30 as are the lower borders of the cavities delineated by the lips.

Figure 7:
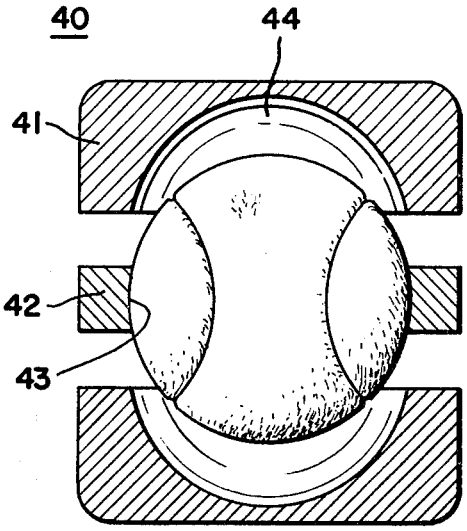
FIG. 7 is a view similar to FIG. 3 of a further embodiment of the present invention.

The embodiment of the present invention shown in FIG. 7 is similar to that last described except for the peripheral face of the collar openings being concave instead of convex. The modified receptacle 40 includes a pair of mold members 41 similar to mold members 33 and a collar member 42 differing from collar member 32 only in that the peripheral faces 43 of the openings of collar member 43 are concave and similar in curvature to the spherically faced cavities 44 in mold members 41 so that upon closure of the receptacle 40 true full spherical cavities are formed of slightly less diameter than the unstressed diameter of ball B. The application, use and operation of receptacle 40 are similar to those of receptacle 30.

Figure 8:
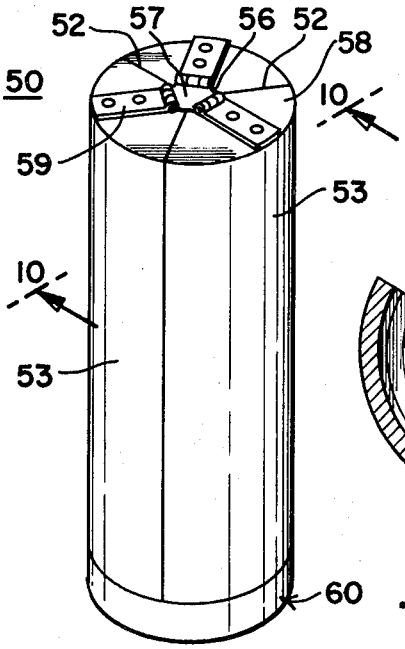
FIG. 8 is a front perspective view of still a further embodiment of the present invention shown in a closed condition.
Figure 9:
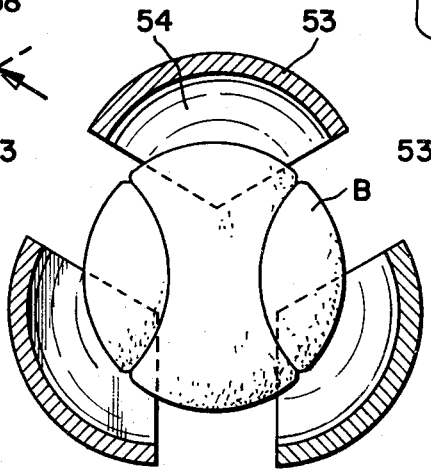
FIG. 9 is a transverse sectional view through a cavity in the partially open receptacle of FIG. 8.
Figure 10:
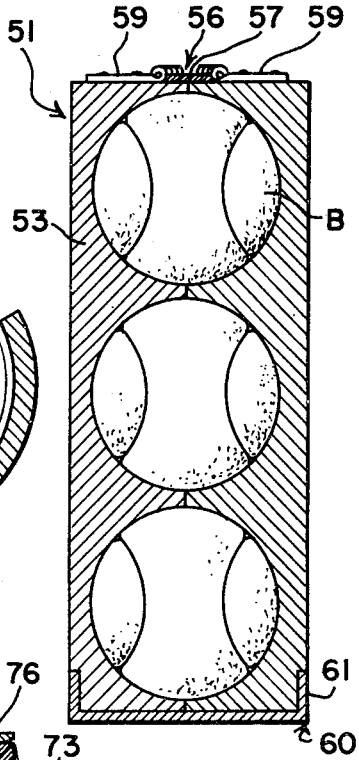
FIG. 10 is a medial longitudinal sectional view taken along the vertical plane of line 10—10 in FIG. 8.

The ball press receptacle 50 embodying the present invention illustrated in FIGS. 8 to 10 includes a vertical cylindrical body member 51 divided into three similar sections of sector shaped transverse cross section by radial vertical planes 52 which are at 120° dihedral angles to each other. Formed in the inside face of each section 53 are three vertically spaced cavities 54 which are spherically faced and each constitutes $\frac{5}{8}$ of a full sphere and are so related that with the contracted assembly of sections 53 the cavities 54 form three vertically spaced spherical cavities whose diameters are somewhat less than that of the standard fresh tennis ball B.

The receptacle sections 53 are interconnected for swinging between relatively expanded open positions and a contracted closed condition about horizontal transverse axes proximate their inner top edges by a hinge assembly 56 including a hexagonal hinge plate 57 centrally located atop the body member 51 and provided along alternate edges with hinge knuckles. Fastened to the top face 58 of each body section 53 is a medially disposed radially extending hinge plate 59 terminating at its inner end with hinge knuckles which interdigitate corresponding knuckles on hinge plate 57 and are coupled thereto by suitable hinge pins. A peripheral groove is formed in the bottom border of each section 53 so that the contracted sections 53 may be releasably locked in their closed position by applying a locking cap 60 to the bottom of the closed body member 51 with the cylindrical skirt wall 61 of cap 60 engaging the circular peripheral groove, as shown in FIG. 10.

In employing the receptacle 50, the body sections 53 are swung outwardly to their open positions to expose the individual cavities 54. A pair of the body sections 53 are partly contracted and balls B are inserted into each of the medially partly opened and fully top opened cavities formed by pairs of adjacent cavities 54 and the respective pair of sections 53 are then fully contracted. Thereafter, the third section 53 is swung to its fully closed position to enclose each of the balls B in a corresponding spherical cavity of smaller size than that of the externally unstressed ball to compress the balls along their full surface. The sections 53 are then releasably locked in their closed positions by applying the cap 60 to the lower part of the body member 61. The balls are released merely by removing cap 60 and permitting the sections to swing to their open diverging positions.

Figure 11:
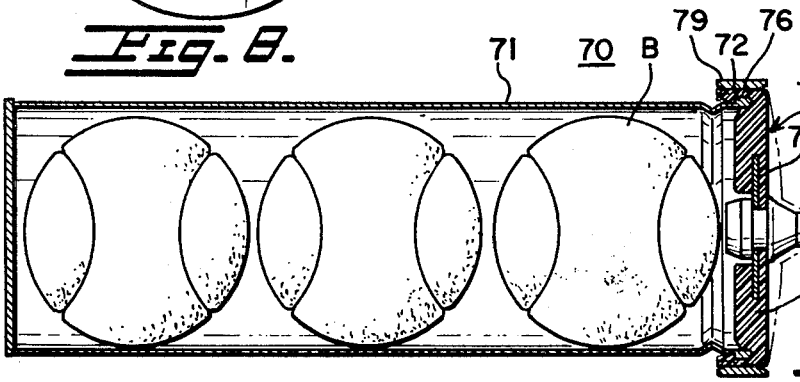
FIG. 11 is a longitudinal medial sectional view of another embodiment of the present invention.

A different form of ball preserving receptacle 70 is illustrated in FIG. 11 of the drawing and includes a cylindrical metal container 71 which is defined by the conventional tennis ball dispensing container of the pressurized type after the end wall has been removed to provide axis to the balls B, the open end of the container having a beaded peripheral border 72. In order to close and seal the container and permit the pressurizing thereof there is provided a closure or cap member 73 which includes a relatively thick disc shaped top wall defining body member 74 formed of a flexible, preferably elastomeric material such as artificial or natural rubber having an integrally formed peripheral skirt wall 76, the inside diameter of which is approximately equal to or slightly less than that of the outer edge of the beaded border 72. A rigid annulus 77 is centrally imbedded in body member 74 and axial openings are formed in body member 74 in alignment with the central opening in annulus 77.

An inflation or check valve assembly 78 of conventional construction, such as that employed with automobile tires is axially mounted on and projects through the openings in body member 74 and annulus 77 and is hermetically sealed thereto and is provided proximate its base with an annular groove engaging the annulus 77 and the body member section bordering the central opening therein. The outer portions of the annulus and body member are tightly embraced between the side faces of the groove. In order to releasably secure the closure member 73 to container 71 and prevent the expansion of skirt wall 76 there is provided a locking collar 79 which is of a diameter to embrace the skirt 76 which, when in the receptacle closed condition, engages the outer border of container 71 about the beaded edge 72.

In employing the receptacle 70 one or more balls B are inserted into the container 71 and the closure member 73 and the locking collar 79 is then applied thereto with body member 74 partially projecting into the container 71 and with the skirt wall engaging the receptacle border 72, to effect an hermetic seal therewith. When the receptacle is pressurized, the inside face of the skirt wall 76 molds to the shape of the container border 72 to effect an anchoring thereto by reason of the shoulder defined by the underface of the beaded edge 72. The interior of the container 71 is then pressurized by filling it with compressed air through the valve 78 to the desired pressure. It should be noted that the outward bulging of the closure member 73 is an indication of the pressure within the container 71. The balls B may be removed by relieving the pressure in the container through the valve 78 in the known manner, the collar 79 then removed and the closure member separated from the container 71. This construction has been found to be useful in maintaining the pressure in an open soda can having generally the same lip construction as the tennis ball can. If the valve were retained, carbon dioxide could be introduced into the can, or dispersed with, since no air is reintroduced.

While there have been described and illustrated preferred embodiments of the present invention, it is apparent that numerous alterations, omissions and additions may be made without departing from the spirit thereof.

What is claimed is:

1. A cap for closing the open end of a cylindrical container to form a storage receptacle capable of maintaining pressure therein comprising a closure member formed of an elastomeric material including relatively thick central portion releasably engaging the open end of said container and a relatively thin annular border, a locking collar slidably engaging said annular border and holding it in compressed engagement with the outer face of said container said open end, and an inflation valve mounted on said closure member and providing communication between opposite sides thereof.

2. The storage receptacle of claim 1 including an outwardly directed lip formed along the periphery of said container opening.

* * * * *